United States Patent [19]

Wild et al.

[11] 4,411,669

[45] Oct. 25, 1983

[54] PROCESSES FOR DYEING PAPER, AND AGENTS CONTAINING AZO DYESTUFFS

[75] Inventors: Peter Wild, Alten Buseck; Horst Nickel, Leverkusen, both of Fed. Rep. of Germany

[73] Assignee: Bayer Aktiengesellschaft, Leverkusen, Fed. Rep. of Germany

[21] Appl. No.: 352,722

[22] Filed: Feb. 26, 1982

[30] Foreign Application Priority Data

Mar. 17, 1981 [DE] Fed. Rep. of Germany ..... 3110223

[51] Int. Cl.[3] ..... D06P 1/41; D21H 3/80; D21H 1/46

[52] U.S. Cl. ..... 8/654; 8/919; 162/162

[58] Field of Search ..... 8/654, 919; 162/162

[56] References Cited

U.S. PATENT DOCUMENTS

| | | | |
|---|---|---|---|
| 3,454,552 | 7/1969 | Yamaya et al. | 260/190 |
| 3,759,893 | 9/1973 | James | 8/654 |
| 3,876,627 | 4/1975 | Kruckenberg | 8/654 |

FOREIGN PATENT DOCUMENTS

| | | | |
|---|---|---|---|
| 24321 | 4/1981 | Fed. Rep. of Germany . | |
| 43-12929 | 5/1968 | Japan | 8/654 |
| 630463 | 10/1949 | United Kingdom . | |

*Primary Examiner*—Maria Parrish Tungol

*Attorney, Agent, or Firm*—Sprung, Horn, Kramer & Woods

[57] ABSTRACT

Cationic azo dyestuffs of the formula (I)

wherein $X^{(+)}$ denotes an ammonium group, m denotes 0 or 1,

R denotes hydrogen, halogen, $C_1$- to $C_4$-alkyl, $C_1$- to $C_4$-alkoxy, hydroxyl, amino, sulphonamido and carboxamido, or acylamino which is optionally substituted by halogen or a quaternary group, $R^1$ denotes hydrogen, $C_1$- to $C_4$-alkyl, halogen or $C_1$- to $C_4$-alkoxy, $R_2$ and $R_3$ independently of one another denote hydrogen, $C_1$- to $C_4$-alkyl, $C_1$- to $C_4$-alkoxy or acylamino, and $An^{(-)}$ denotes an anion, and wherein the azo group and hydroxyl group of ring a are located adjacent to one another and further carbocyclic or heterocyclic rings can be fused to ring a, are used for dyeing paper.

12 Claims, No Drawings

PROCESSES FOR DYEING PAPER, AND AGENTS CONTAINING AZO DYESTUFFS

The invention relates to processes for dyeing paper with cationic azo dyestuffs of the formula

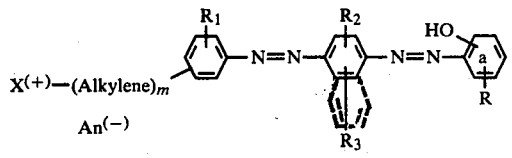

(I)

wherein $X^{(+)}$ denotes an ammonium group, m denotes 0 or 1,

R denotes hydrogen, halogen, $C_1$- to $C_4$- alkyl, $C_1$- to $C_4$-alkoxy, hydroxyl, amino, sulphonamido and carboxamido, or acylamino which is optionally substituted by halogen or a quaternary group, $R^1$ denotes hydrogen, $C_1$- to $C_4$-alkyl, halogen or $C_1$- to $C_4$-alkoxy, $R_2$ and $R_3$ independently of one another denote hydrogen, $C_1$- to $C_4$-alkyl, $C_1$- to $C_4$-alkoxy or acylamino, and $An^{(-)}$ denotes an anion, and wherein the azo group and the hydroxyl group of ring a are located adjacent to one another and further carbocyclic or heterocyclic rings can be fused to ring a, and agents which contain these dyestuffs.

Alkylene particularly represents a radical having 1 to 3 carbon atoms. Acylamino is preferably understood as meaning optionally halogen-substituted or ammonium-substituted $C_1$- to $C_3$-alkylcarbonylamino, $C_1$- to $C_3$-alkylsulphonylamino, aminocarbonylamino or benzoylamino, particularly however, acetylamino, propionylamino or aminocarbonyl.

Halogen preferably represents chlorine or bromine.

Amongst the dyestuffs of the formula (I), the dyestuffs of the formula

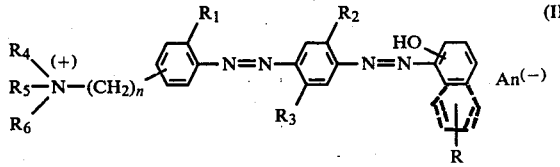

(II)

are to be singled out wherein

R, $R_1$, $R_2$, $R_3$ and $An^{(-)}$ have the meanings given in formula I, and n denotes 0 to 2, $R_4$, $R_5$ and $R_6$ independently of one another denote hydrogen, $C_1$- to $C_4$-alkyl, $C_3$- to $C_4$-alkenyl, benzyl or phenylethyl, which can be substituted by hydroxyl, $C_1$- to $C_4$-alkoxy, chlorine or cyano, and the benzyl radical and phenylethyl radical, in addition, can be substituted by $C_1$- to $C_4$-alkyl, or $R_4$ and $R_5$, together with the nitrogen atom, form a piperidine, morpholine, piperazine or pyrroline ring which is optionally substituted by $C_1$–$C_4$-alkyl, or $R_4$, $R_5$ and $R_6$, together with the nitrogen atom to which they are bonded, form a pyridine ring which is optionally substituted by $C_1$–$C_4$-alkyl.

Particularly suitable dyestuffs of the formula (II) are those wherein

R represents hydrogen, methyl, sulphonamido or carboxamido, aminocarbonylamino or acetylamino or propionylamino which is optionally substituted by halogen or the group

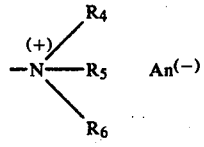

$R_1$ represents hydrogen, methyl, chlorine or methoxy, $R_2$ and $R_3$ independently of one another represent hydrogen, methyl, methoxy, aminocarbonylamino or acetylamino or propionylamino which is optionally substituted by halogen or the group

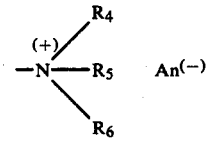

and $R_4$, $R_5$ and $R_6$ independently of one another represent methyl, ethyl, hydroxyethyl, chloroethyl, cyanoethyl, benzyl or allyl, or, together with the nitrogen atom, a pyridine ring which is optionally substituted by methyl.

Suitable anions $An^{(-)}$ are the colourless organic and inorganic anions which are customary for cationic dyestuffs, for example chloride, bromide, iodide, hydroxide, bisulphate, sulphate, nitrate, dihydrogen phosphate, phosphate, carbonate, perchlorate, fluoborate, chlorozincate, methosulphate, ethosulphate, acetate, propionate, lactate, citrate, benzenesulphonate and toluenesulphonate.

In general, the anion is determined by the preparation process. The dyestuffs are preferably present as chlorides, bisulphates, sulphates, methosulphates, phosphates, acetates, lactates or citrates. The anions can be replaced, in a known manner, by other anions, and can be present as mixtures.

For dyeing paper, the dyestuffs (I) are either used as dyestuff powder preparations or are preferably employed in the form of concentrated dyestuff solutions. Powder preparations are formulated in the customary manner, using extenders such as sodium sulphate, phosphates, chloride or acetate, or are made available commercially as spray-dried brands. The concentrated dyestuff solutions can be of an aqueous or aqueous/organic type, customary organic additives which are non-pollutant and which have the highest possible degradability being preferred, such as organic acids, such as acetic acid or formic acid, amides, such as formamide or dimethylformamide, urea, and alcohols, such as glycol, diglycol or diglycol ether, particularly the methyl ethers or ethyl ethers thereof. The preparation of the concentrated dyestuff solutions is effected in a customary manner, for example by dissolving the dyestuff (as a paste or powder) in a suitable solvent or solvent mixture.

After dilution with water, the dyestuff powders or solutions are generally used for continuously or discontinuously dyeing paper.

The dyestuffs are employed for dyeing paper pulp or for colouring the surface of the paper. They are suitable for sized and for unsized paper types prepared from bleached or unbleached pulp of various origins, such as softwood or hardwood sulphite and/or sulphate pulp.

The dyeing is preferably effected at pH values of from 4 to 8, particularly at pH 5 to 7. In general, the dyeing temperature is 10° to 50° C., preferably about 20° C. (room temperature).

The auxiliaries and fillers customary in paper dyeing and paper manufacture can be concomitantly used when using the dyestuffs according to the invention.

The dyestuffs have an excellent affinity in paper dyeing.

The paper dyeings obtained with the dyestuffs according to the invention are distinguished by very good fastness to water (fastness to bleeding), as well as fastness to acid, alkali and alum.

The brilliancy and clarity of the shades may also be pointed out. Furthermore, the behaviour in combination with suitable dyestuffs is very good.

The dyestuffs of the formula (I) are known, for example from U.S. patent specification No. 602,637, German Patent Specification 93,499, German Patent Specification 95,530 and DE-AS (German Published Specification) No. 1,005,486, and were previously employed for dyeing tanned cotton, wool-cotton union and polyacrylonitrile. It is therefore surprising that they give almost colourless waste liquors in paper dyeing, even without auxiliaries, with good wet fastnesses of the dyeings obtained.

The dyestuffs of the formula (I) are prepared by a process in which, in a known manner, aminoazo compounds of the formula

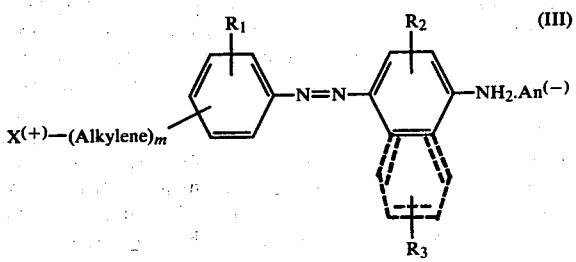

wherein $X^{(+)}$, m, $R_1$, $R_2$, $R_3$ and $An^{(-)}$ have the meanings given in formula (I), are diazotised and are coupled with compounds of the formula

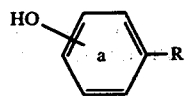

(IV)

wherein

R and ring a have the meanings given in formula (I).

EXAMPLE 1

A dry stuff consisting of 60% of ground woodpulp and 40% of unbleached sulphite pulp is mixed with water in a hollander and beaten to a freeness of 40° SR, so that the solids content is a little above 2.5%, and is then adjusted with water to exactly 2.5% solids content of the high density pulp.

5 parts of a 0.5% strength aqueous solution of the dyestuff of the formula

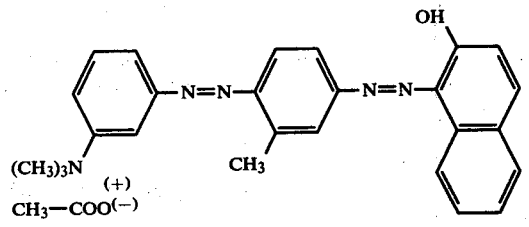

are added to 200 parts of the high density pulp, the mixture is stirred for approximately 5 minutes, 2% of resin size and 4% of alum (relative to dry stuff) are added, and the mixture is again stirred for a few minutes until it is homogeneous. The pulp is then diluted with approximately 500 parts of water and paper sheets are prepared from this pulp, in the customary manner, by sucking off over a sheet-forming apparatus. The paper sheets exhibit a pronounced bluish-red dyeing. The waste water of the dyeing is virtually free of dyestuff.

When unsized paper pulp is dyed under otherwise identical dyeing conditions, a pronounced bluish-red dyeing with waste water which is practically free of dyestuff is also obtained.

If bleached sulphite pulp is used for the preparation of the high density pulp and this pulp is employed for dyeing, bluish-red paper dyeings and waste water which is virtually free of dyestuff are obtained according to the process given above.

If, instead of the above dyestuff, corresponding quantities of dyestuffs or dyestuff solutions described in the examples below are used, paper dyeings are obtained, the shades of which are indicated in the individual dyestuff examples.

| Example No. | Dyestuff | Shade |
|---|---|---|
| 2 | 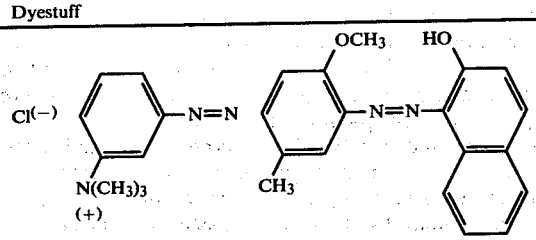 | violet |

-continued
| Example No. | Dyestuff | Shade |
|---|---|---|
| 3 | 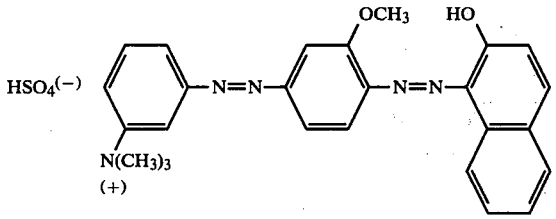 | bordeaux |
| 4 | 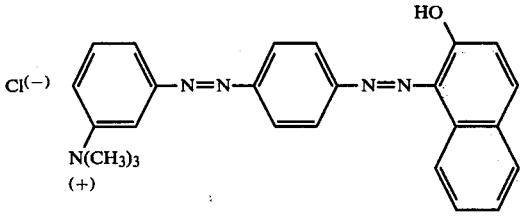 | red |
| 5 | 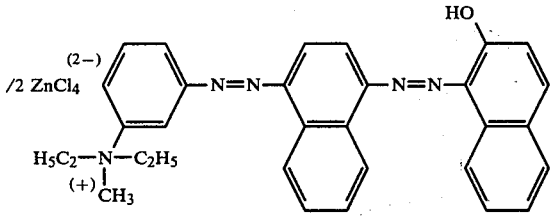 | blue-violet |
| 6 | 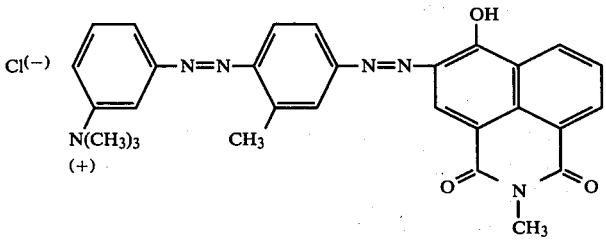 | blue-red |
| 7 | 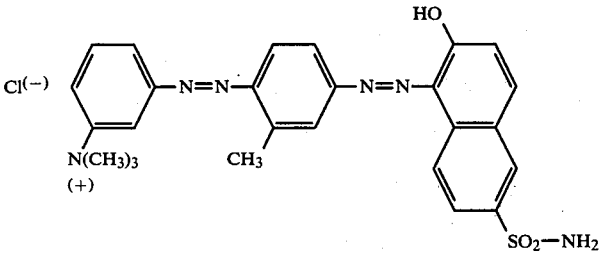 | bluish-red |
| 8 | 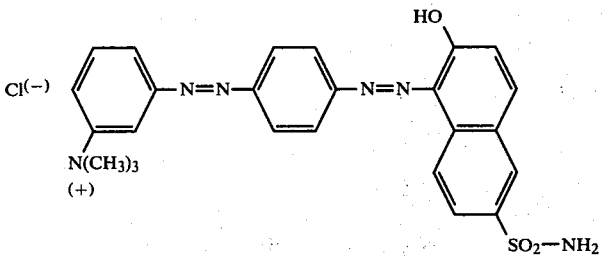 | bluish-red |

-continued
| Example No. | Dyestuff | Shade |
|---|---|---|
| 9 | 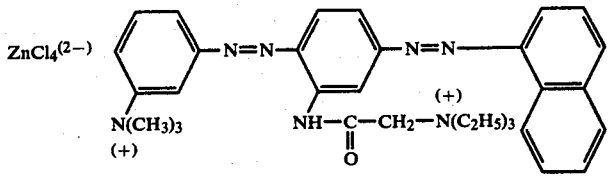 | scarlet |
| 10 | 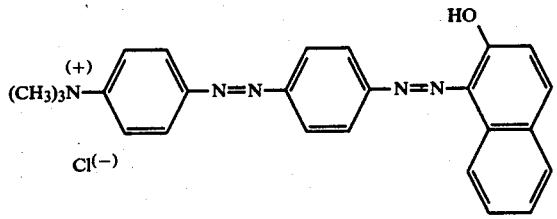 | red |
| 11 | 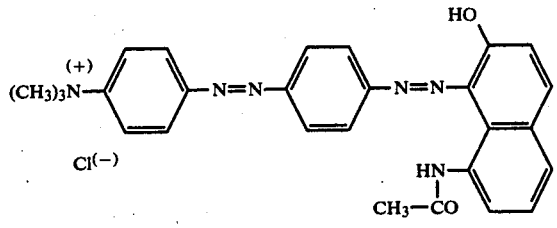 | blue-red |
| 12 | 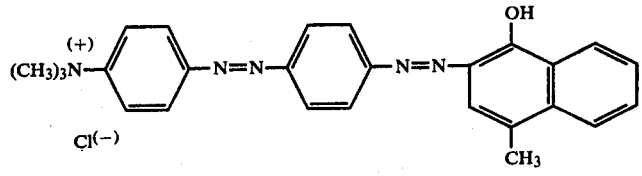 | bordeaux |
| 13 | 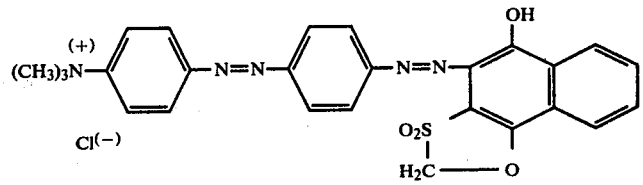 | bordeaux |
| 14 | 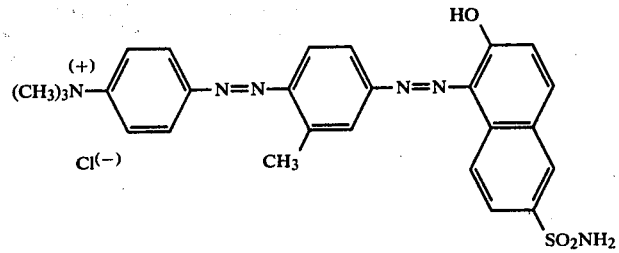 | red |
| 15 | 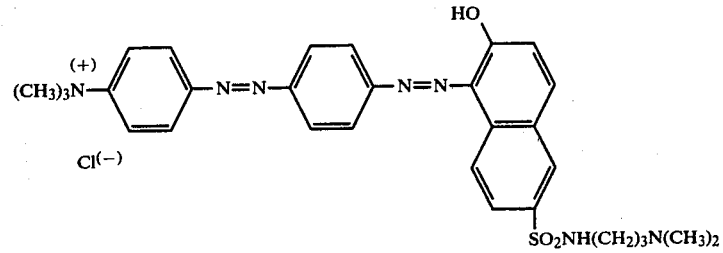 | scarlet |

-continued

| Example No. | Dyestuff | Shade |
|---|---|---|
| 16 | 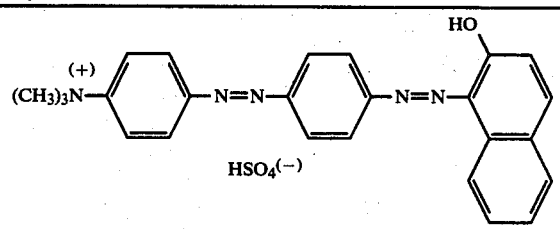 | blue-red |
| 17 | 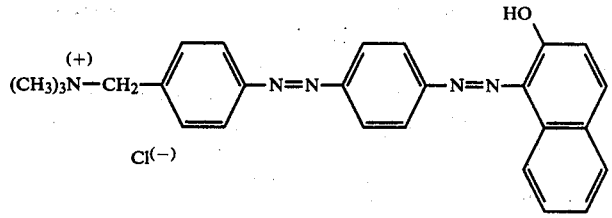 | red |
| 18 | 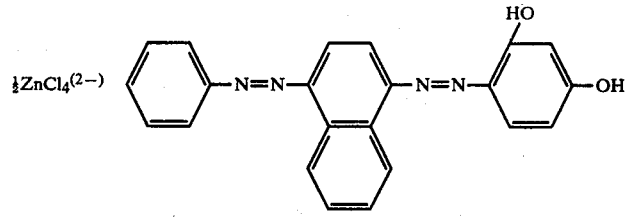 | brown-violet |
| 19 | 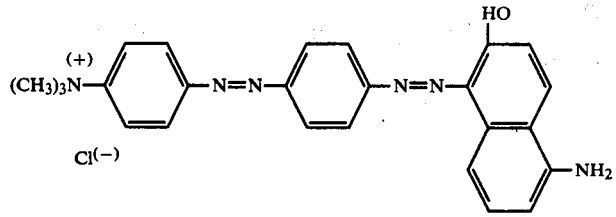 | violet |

We claim:

1. Process for dyeing paper, comprising contacting paper or paper pulp with cationic azo dyestuffs of the formula

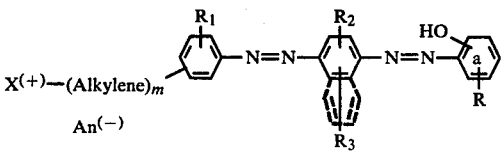

(I)

wherein $X^{(+)}$ denotes an ammonium group, m denotes 0 or 1,

R denotes hydrogen, halogen, $C_1$- to $C_4$-alkyl, $C_1$- to $C_4$-alkoxy, hydroxyl, amino, sulphonamido, carboxamido, or acylamino which is unsubstituted or substituted by halogen or a quaternary group, $R^1$ denotes hydrogen, $C_1$- to $C_4$-alkyl, halogen or $C_1$- to $C_4$-alkoxy, $R_2$ and $R_3$ independently of one another denote hydrogen, $C_1$- to $C_4$-alkyl, $C_1$- to $C_4$-alkoxy or acylamino, and $An^{(-)}$ denotes an anion, and wherein further carbocyclic or heterocyclic rings are fused to ring a.

2. Process according to claim 1, wherein said cationic azo dyestuffs are of the formula

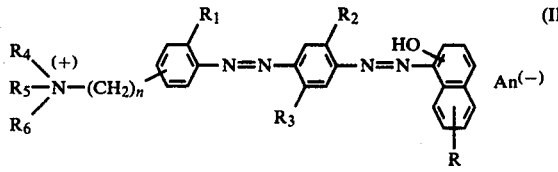

(II)

wherein

R, $R_1$, $R_2$, $R_3$ and $An^{(-)}$ have the meanings given in formula I, and n denotes 0 to 2, $R_4$, $R_5$ and $R_6$ independently of one another denote hydrogen, $C_1$- to $C_4$-alkyl, $C_3$- to $C_4$-alkenyl, benzyl or phenylethyl, which are unsubstituted or substituted by hydroxyl, $C_1$- to $C_4$-alkoxy, chlorine or cyano, and the benzyl radical and phenylethyl radical, in addition are unsubstituted or substituted by $C_1$- to $C_4$-alkyl, or $R_4$ and $R_5$, together with the nitrogen atom, form a piperidine, morpholine, piperazine or pyrroline ring which is unsubstituted or substituted by $C_1$–$C_4$ -alkyl, or $R_4$, $R_5$ and $R_6$, together with the nitrogen atom to which they are bonded, form a pyridine ring which is unsubstituted or substituted by $C_1$–$C_4$-alkyl.

3. Process according to claim 2 wherein

R represents hydrogen, methyl, sulphonamido or carboxamido, aminocarbonylamino or acetylamino or propionylamino which is unsubstituted or substituted by halogen or the group

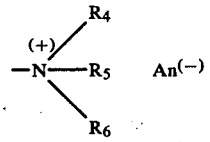

and wherein $R_1$ represents hydrogen, methyl, chlorine or methoxy, $R_2$ and $R_3$ independently of one another represent hydrogen, methyl, methoxy, aminocarbonylamino or acetylamino or propionylamino which is unsubstituted or substituted by halogen or the group

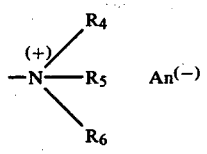

and wherein $R_4$, $R_5$ and $R_6$ independently of one another represent methyl, ethyl, hydroxyethyl, chloroethyl, cyanoethyl, benzyl or allyl, or, together with the nitrogen atom, a pyridine ring which is unsubstituted or substituted by methyl.

4. Process according to claim 1, wherein said Alkylene is a radical having 1 to 3 carbon atoms.

5. Process according to claim 1, wherein said acylamino is selected from the group consisting of halogen substituted $C_1$- to $C_3$-alkylcarbonylamino, halogen-substituted $C_1$- to $C_3$-alkylsulphonylamino, halogen-substituted aminocarbonylamino, halogen-substituted benzoylamino, ammonium-substituted $C_1$- to $C_3$-alkylcarbonylamino, ammonium-substituted $C_1$- to $C_3$-alkylsulphononylamino, ammonium-substituted aminocarbonylamino and ammonium-substituted benzoylamino.

6. Process according to claim 1, wherein said ($An^-$) is selected from the group consisting of chloride, bromide, iodide, hydroxide, bisulphate, sulphate, nitrate, dihydrogen phosphate, phosphate, carbonate, perchlorate, fluoborate, chlorozincate, methosulphate, ethosulphate, acetate, propionate, lactate, citrate, benzenesulphonate and toluenesulphonate.

7. Process according to claim 1, carried out at pH values from 4 to 8.

8. Process according to claim 1, carried out at pH values from 5 to 7.

9. Process according to claim 1, carried out at 10° C. to 50° C.

10. Process according to claim 1, carried out at about 20° C.

11. Process according to claim 1, wherein a benzene ring is fused to ring a.

12. A dyed paper produced by the process of claim 1.

* * * * *